US006683287B2

(12) United States Patent
Behnke et al.

(10) Patent No.: US 6,683,287 B2
(45) Date of Patent: Jan. 27, 2004

(54) PROCESS AND DEVICE FOR FIXING TONER ONTO A SUBSTRATE OR PRINTED MATERIAL

(75) Inventors: Knut Behnke, Kiel (DE); Hans-Otto Krause, Eckernförde (DE); Frank-Michael Morgenweck, Molfsee (DE); Domingo Rohde, Kiel (DE); Detlef Schulze-Hagenest, Molfsee (DE); Gerhard Bartscher, Köln (DE); Kai-Uwe Preissig, Dortmund (DE); Dinesh Tyagi, Fairport (DE)

(73) Assignee: NexPress Solutions LLC, Rochester, NY (US)

( * ) Notice: Subject to any disclaimer, the term of this patent is extended or adjusted under 35 U.S.C. 154(b) by 139 days.

(21) Appl. No.: 10/011,354

(22) Filed: Dec. 4, 2001

(65) Prior Publication Data

US 2002/0088799 A1 Jul. 11, 2002

(30) Foreign Application Priority Data

Dec. 22, 2000 (DE) ..... 100 64 565
Sep. 12, 2001 (DE) ..... 101 45 002

(51) Int. Cl.[7] ..... H05B 6/80
(52) U.S. Cl. ..... 219/678; 219/693; 399/336
(58) Field of Search ..... 219/678, 679, 219/691, 693, 692, 695, 746, 750, 216, 388; 399/335, 336, 337

(56) References Cited

U.S. PATENT DOCUMENTS

| | | | | | |
|---|---|---|---|---|---|
| 4,456,683 | A | * | 6/1984 | Petcavich | 399/336 |
| 4,482,239 | A | * | 11/1984 | Hosono et al. | 399/336 |
| 4,511,778 | A | | 4/1985 | Takahashi et al. | 219/691 |
| 4,542,980 | A | * | 9/1985 | Tajima | 399/336 |
| 5,536,921 | A | | 7/1996 | Hedrick et al. | 219/693 |
| 5,631,685 | A | * | 5/1997 | Gooray et al. | 347/102 |

* cited by examiner

*Primary Examiner*—Quang T. Van
(74) *Attorney, Agent, or Firm*—Lawrence P. Kessler

(57) ABSTRACT

A device and process for fixing a toner onto a substrate or a printed material, especially a sheet-shaped printed material, preferably for a digital printer, which is characterized in that the printed material that has the toner is irradiated with microwaves from at least one microwave emitter, and is heated to melt the toner, and that a toner is used which exhibits a sharp drop of the modulus of elasticity G' from its solid to its liquid state when it is heated. Preferably, the ratio of the value of the modulus of elasticity G' of the toner according to the invention at the reference temperature value, calculated from the starting temperature at the beginning of the glass transformation of the toner plus 50° C., to the value of the modulus of elasticity G' at the starting temperature itself is $<10^{-5}$.

10 Claims, 6 Drawing Sheets

PROCESS AND DEVICE FOR FIXING TONER ONTO A SUBSTRATE OR PRINTED MATERIAL

FIELD OF THE INVENTION

The invention involves a device and process for fixing a toner onto a substrate or a printed material, especially a sheet-shaped or a band-shaped printed material, preferably for a digital printer.

BACKGROUND OF THE INVENTION

In digital printing, especially electrostatic or electrophotographic printing, a latent electrostatic image is generated, which is developed by charged toner particles. These toner particles are transferred onto a printed material, e.g. paper, that receives the image. The image transferred onto the printed material is fixed there by heating and softening of the toner or heating of the printed material. Through and during this process, toner particles bond to the printed material and, possibly, also to each other.

For the fixing of the toner onto the printed material, the use of microwaves is known. Since the absorption of microwave energy in the toner customarily is at least one order of magnitude less than in the printed material, the printed material is preferably heated up by the microwaves and the printed material for its part heats up the toner located on it, and, to be precise, up to a temperature at which the toner bonds to the printed material. As is known, characteristic values of the printed material used, such as, for example, weight, humidity, and composition, are critical in the use of microwaves for fixing of the toner and must be taken into consideration.

Thus, for example, an image-fixing device is known from U.S. Pat. No. 4,511,778, which fixes an image made of toner using high-frequency waves, in particular, microwaves, onto a printed material, especially a sheet of paper. One aspect of the known device is thus the possibility to output the microwaves depending on the size of the printed material, in order to ensure a proper fusing and fixing of the toner taking into account this size as a characteristic value of the printed material. This is a method that only takes into consideration a size of the printed material that is directly apparent and specifies for the operation of the device, prior to fixing, based on consideration, for example, that a larger piece to be heated requires more energy in total than a smaller piece to be heated, because of its larger heat capacity.

However, additional critical aspects remain unconsidered in the use of microwaves for the fixing of toner. Thus, for example, the cited method can only be used in black-white printing with paper weights of a small variation width, while the possibly different behavior of different colored toner and different paper weights, also with possibly different water content, is not considered in this all-inclusive method that is matched to the size of the printed material. In a color print, the toner image can, for example, have four different toner layers. In the process, the maximum density of each toner layer on the image-receiving substrate or printed material is 100%, whereby a maximum total density of the toner layers in the toner image of 400% results. Customarily, the density of a single-color toner image is in the range from 0% to 100% density, and the density of a color toner image is in the range from 0% to 290%. Moreover, the cited device does not contain a microwave resonator, which is desirable when using the microwave application in regard to a homogenous heating, whereby customarily even at least two resonators arranged offset from each other are used, as is known from the patent U.S. Pat. No. 5,536,921 for a general microwave heating outside of the print area.

In addition, during the use of sheet-shaped printed material, a problem can occur that in the area of the edge area of the sheet irradiated with microwaves, processing is done in an energetically different way than the middle sheet area, so that a non-uniformly created printed product can occur. In addition to this, it occurs that during the fixing of traditional toners, only when using microwaves under certain circumstances, only an incomplete melting of the toner is obtained depending on its layer thickness, or heating occurs with bubble formation in areas of the toner. Also, the adhesion of the toner onto the printed material is insufficient under certain circumstances, because, for example, the bond with the printed material is not created sufficiently by the viscosity of the melted toner, which is too high. Problems can occur especially when a printed material is printed on both sides in two subsequently performed printing operations.

Because of these possible problems depicted, the use of microwave radiation in fixing is traditionally and customarily not relied upon, but instead, the toner is in practice heated without microwave radiation and bonded to the printed material using a heated pair of rollers while being impinged with pressure. A non-contact fixing is in principal, however, desirable for the protection of the printed image. Additional advantages of the non-contact fixing are the avoidance of adhesive abrasion and the resultant increased service lifetime of the device used, and an improved reliability of the device.

SUMMARY OF THE INVENTION

The purpose of this invention is to make possible an adequate fixing of toner onto a printed material using microwaves, preferably also for a multicolor printing on sheet-shaped printed material and using a resonator and preferably by adjusting to the special prevalent conditions. This purpose is achieved according to the invention in regard to the process in that the printed material that has the toner is irradiated with microwaves from at least one microwave emitter and is heated to melt the toner and that a toner is used which has a sharp transition from its solid to its liquid state during heating.

In this way according to the invention, for example, a dry toner can be used which is still quite hard at an average temperature of approximately 50° C. to 70° C., so that it can be powdered via conventional processes into a desired average toner size of, for example, 8–4 micrometers and also does not yet become sticky or does not melt at development temperatures, but at a higher temperature of, for example, approximately 90° C. is already very fluid at low viscosity, so that it, if necessary in using capillarities, also without outside pressure and in a non-contact manner settles on and in the printed material and adheres and upon a cooling down then becomes hard again very quickly and is fixed. To be precise, the fixed toner has a good surface gloss that is matched to the printed material, especially lacking formed grain boundaries. The surface gloss also plays a direct, meaningful role for color saturation in colored toner.

In this process, in connection with the toner according to the invention, the ratio of the value of the modulus of elasticity G' at the reference temperature value, calculated from the starting temperature at the beginning of the glass transformation of the toner plus 50° C., to the value of the modulus of elasticity at the starting temperature itself can be <1E−5, preferably even <1E−7, whereby E represents the base 10 exponent. The starting temperature of the beginning of the glass transformation of the toner is preferably specified as that temperature value at which the tangents to the function progression of the modulus of elasticity G', as a function of the temperature before and after the glass transformation, intersect. Preferably, the transformation of the toner from its solid into its liquid state should occur in a temperature interval or temperature window from approximately 30° to 50° C. in size. This range should be above 60° C., preferably approximately between 70° C. to 130° C., quite preferably between 75° C. and 125° C.

An additional further embodiment of the process according to the invention is characterized for adjusting to the special conditions in that at least one physical process parameter is controlled or regulated as a function of a parameter that correlates to the energy input into the printed material that has the toner. In this process, the energy input mentioned can essentially correspond to a microwave power that has been absorbed by the entire system out of printed material and toner, so that, according to the invention, corresponding to the actual relationships, the energy that has been output is compared to the absorbed power and tuned. This in turn corresponds essentially to an efficiency control or adjustment. In the process, the performance of a regulation on the emitter in the most general sense or on the absorbing toner-printed material system or on its handling is generally taken into consideration.

For this purpose, the invention preferably proposes in detail to regulate the output of the microwave emitter or to regulate the speed of the movement of the printed material or to tune the resonator or to tune the frequency of the microwaves, and this last measure preferably also in order to achieve a higher energy absorption directly in the toner itself, and in this way to have a more precise influence on its fusing than indirectly and more problematically, via the printed material. As measurable parameters for the dependent regulation, the invention preferably proposes the temperature of the printed material or the microwave energy reflected by the toner-printed material system and thus not absorbed. Additional measurable parameters can—without limitation of them—be the weight/the thickness or the water content of the printed material or density and gloss of the toner layer.

As already mentioned above, in regard to the patent U.S. Pat. No. 5,536,921, at least two resonators for the microwaves, which are offset from each other by $\lambda/4$, in order to offset the maxima of the standing waves in the resonators correspondingly from each other, are customarily required for a homogenous heating of the printed material that is covered with toner. An additional embodiment of the invention instead provides using only one resonator, which oscillates completely or partially.

An additional embodiment of the invention provides during the use of more than two resonators, to offset them by a length of $\lambda$ divided by two times the number of resonators. In this way, a more uniform temperature distribution is obtained on the substrate than at an offset of $\lambda/4$. In a preferred embodiment of the invention, four resonators are used whose separation distance each amounts to $\lambda/8$. In principal, all frequencies of the microwave range from 100 MHz to 100 GHz can be used. Usually, the ISM-frequencies released for industrial, scientific or medicinal use, preferably, 2.45 GHz, are used. A use of other frequencies in the wide frequency range mentioned can, however, advantageously lead to a larger portion of the radiation energy being absorbed by the toner than is customary, so that it is not just absorbed by the printed material.

Further, a device of the invention is provided herein for the irradiation and heating of the toner that exhibits a sharp transformation from its solid to its liquid state when heated, there is at least one emitter that outputs microwaves. Preferably one or more operating parameters are additionally provided that can be regulated.

The use of at least one resonator is preferred which has a width of approximately 1 to approximately 10 cm in the movement direction of the printed material, in order to simplify the handling of the printed material. It will also make possible a sufficient power (for example, 1–10 kW per resonator) without voltage break-throughs occurring. In this process, the width of the resonator should also be tuned to the speed of the printed material. This involves a relative speed (for example up to 100 cm/s), in such a manner that the fixing device could move in kinematic reversal relative to the stationary printed material or even both components. Also, a stationary fixing without any movement would be conceivable.

The device according to the invention is preferably provided for a digital multi-color printer.

BRIEF DESCRIPTION OF THE DRAWINGS

Exemplary explanations of the process according to the invention are made in the following in relation to 6 figures, from which additional inventive measures result without the invention being restricted to the examples or figures that are explained.

Shown are.

DETAILED DESCRIPTION OF THE INVENTION

The G'-ratio is the ratio of the modulus of elasticity G' at the starting temperature of the glass transformation plus 50° C. to G' at the starting temperature of the glass transformation. The starting temperature of the glass transformation is determined according to FIG. 1 from the intersection point of the tangents at G' prior to and after the glass transformation and is at just under 70° C. in the example shown.

Figure 1:
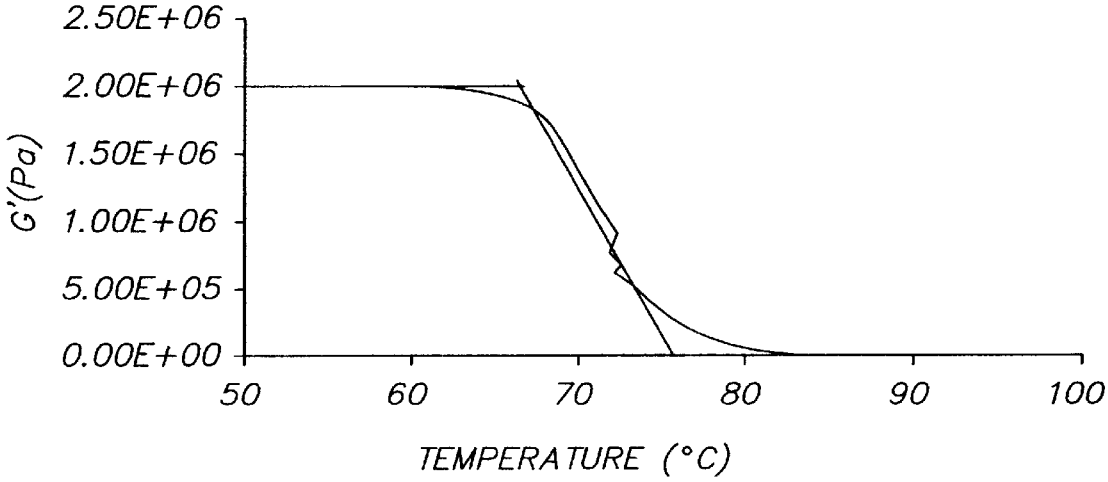
FIG. 1 which represents the functional progression of the modulus of elasticity G' of a toner depending on the temperature, for the definition of the starting temperature of the glass transformation of the toner.
Figure 2:
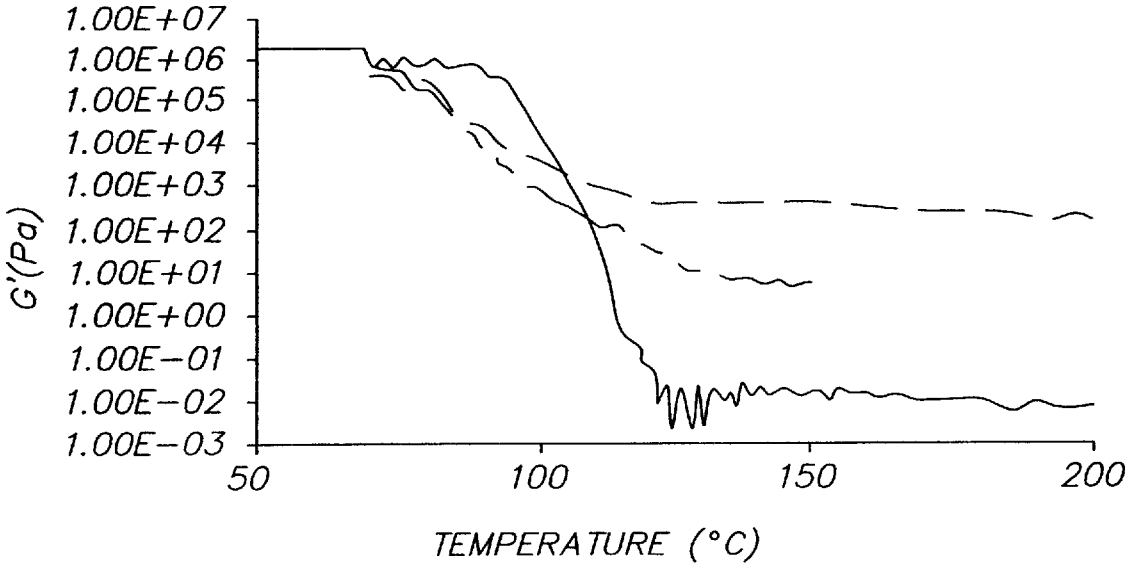
FIG. 2 which represents the measured functional progressions according to FIG. 1 of a toner according to the invention and two toners according to the state of the art for purposes of comparison.

In FIG. 2, the measured functional progression of G' according to FIG. 1 is shown for three exemplary toners. The functional values of G' were determined by a Theological measurement using a Bolin-rheometer, equipped with parallel plates of 40 mm diameter. A continuous temperature change at a frequency of 1 rad/s corresponding to 0.16 Hz was performed between 50° C. and 200° C. The strain of the measurement was selected such that the sample shows no shear thinning (Newton's behavior). Only the toner according to the invention shows a sharp transformation from solid to liquid state with a final G' value of approximately 1.00E−02. From this, a G' ratio of 5.0E−08 results.

EXAMPLES

Example 1

The toner according to the invention is fixed using microwaves in an assembly consisting of 2 resonators, whose maxima are displaced by $\lambda/4$ from each other and which are each supplied by a 2 kW magnetron of a frequency of 2.45 GHz. In this process, a simultaneous fixing of 10% and 290% toner areas on 4CC-type paper, a coated paper for high-quality digital printing, with a surface weight of 130 g/m$^2$ at a process speed of 210 mm/s, was possible. A uniform surface covering of toner on paper is indicated by 100%, and when fixed it has an optical density of approx. 1.4.

Example 2

Figure 4:
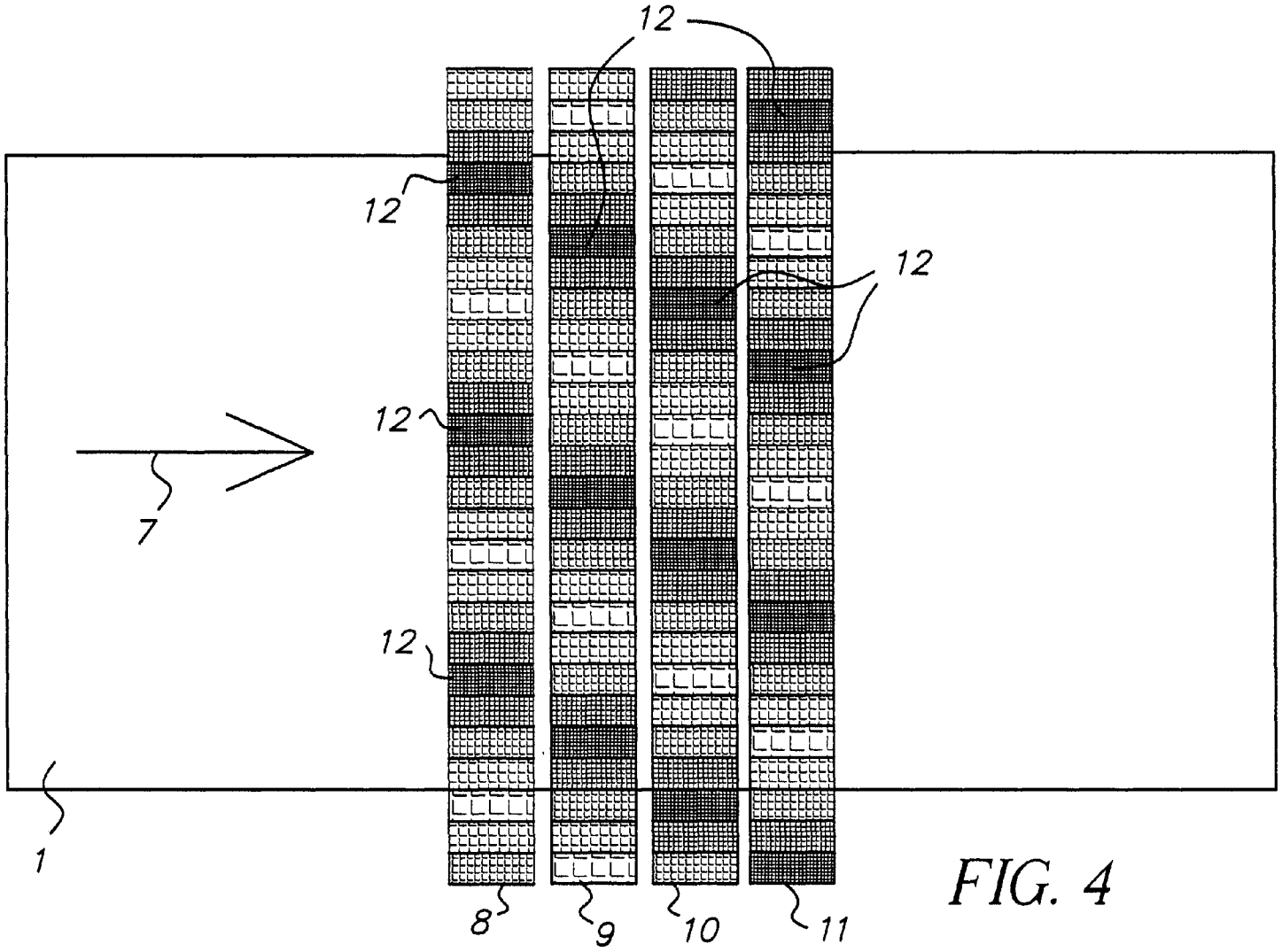

The toner according to the invention is fixed using microwaves in an assembly consisting of 4 resonators, whose maxima are displaced by $\lambda/8$ from each other and which are each supplied by a 2 kW magnetron. The resonators are constructed so that the maxima of the respectively subsequent resonators are displaced by $\lambda/8$ in the same direction relative to the previous ones (FIG. 4). In this way, it is achieved that the respectively subsequent areas on the print are fused one after the other while the toner fused in the previous resonator is still liquid. In this way an especially uniform temperature distribution (FIG. 5) is achieved, and after the toner layer has cooled off below the melting point of the toner, no grain boundaries can be recognized. The same advantage is shown by another arrangement of the resonators according to FIG. 6, whereas the remaining possible arrangements clearly show worse results with regard to temperature distribution and grain boundaries.

It has been discovered that an independent adjustment of the individual resonators for maximum absorption does not lead to satisfactory results. The result of the fixing is non-uniform. The absorption of the printed material in the resonators which are subsequent to each other is, moreover, optimized for the respectively connected preceding resonators, in order to obtain a uniform fixing result. By this operation, a uniform fixing of 10% to 290% toner areas on 4CC-paper with a surface weight of 130 g/m$^2$, an uncoated paper for high-quality digital printing at a process speed of 500 mm/s was possible. At a paper gloss of 9, measured with a gloss measuring device by the Byk-Gardner Co., model 4520, at an angle of 60°, a gloss of the areas impinged with toner up to 12.3 was obtained, whereby the largest value was obtained at the high surface coverages.

Example 3

Similar to example 2, 10% to 290% toner areas were fixed on Magnostar-paper, a coated paper for high-quality digital printing, with a surface weight of 300 g/m$^2$. At a paper gloss of 35, measured at an angle of 60°, a gloss of the areas impinged with toner of up to 37 was obtained, whereby the largest value was obtained at the high surface coverages above 100%.

The two other toners from the state of the art show essentially flatter functional progressions of G' with G'-ratios of 1.9E−03 or 2.2E−05. The fixing relationships of the toners according to the invention could not be realized for these known toners, either by fixing with a heated pair of rollers according to the state of the art, or by fixing with microwaves in a manner similar to Example 1 and Example 2.

Comparative Example 3a

In a comparison test with toner according to the state of the art and fixing in a commercially available heating roller fixing station, only a maximum 60°-gloss of 30 could be obtained on Magnostar-paper, which is clearly below the paper gloss of 35, and does not offer a satisfactory gloss print of large toner areas.

Figure 3:
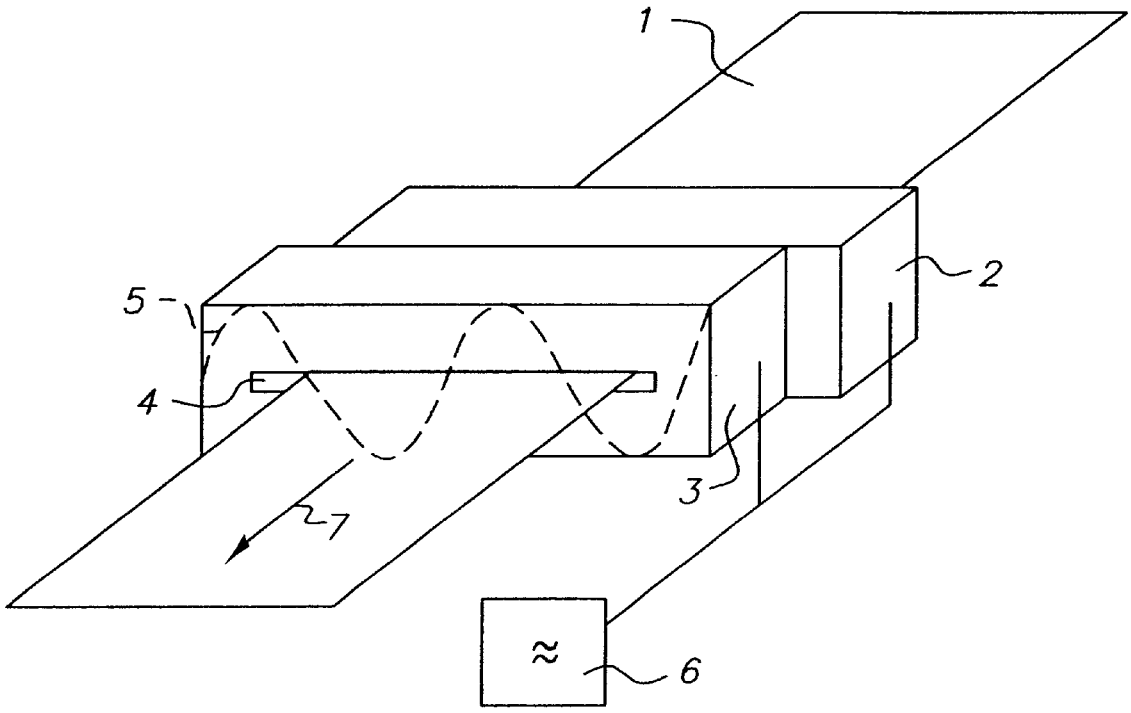
FIG. 3 which is a schematic perspective view of an embodiment example of a device for fixing a toner image according to the invention, FIG. 4 which is a preferred arrangement of 4 resonators of a device according to the invention for fixing a toner image, each of which exhibit maxima of standing microwaves that are offset rectified against each other by $\lambda/8$.

FIG. 3 shows schematically and only for the purposes of example, a perspective view of an embodiment option of a device according to the invention for fixing a toner image, especially for performing the process described above. In FIG. 3, a section of a conveyor belt 1 is shown, on which sheets of a sheet-shaped printed material can be placed one after the other and transported. This conveyor belt 1 leads through a fixing device, which consists, among other things, of two resonators 2 and 3 that are offset from each other. The resonators have at suitable positions an approximately 3–10 mm high slot 4, through which the conveyor belt and the printed material are guided.

As shown in FIG. 3, standing microwaves 5 form in the resonators 2 and 3, the field strength maxima of which are located in the plane of the conveyor belt 1 or the printed material located on it, and in this way especially, heat up the printed material and the toner image located on it, so that the toner image melts and fixes to the printed material when it cools outside of the resonators 2, 3. The resonators 2 and 3 are arranged offset from each other by a fourth of a wavelength of the microwaves 5, in order to obtain a corresponding offset of the maxima of the microwave 5 and to heat up the printed material and the toner image in a relatively uniform manner. In addition, it is noted that the wavelength of this standing microwave 5, hereinafter indicated by "$\lambda$", which corresponds to the progression of the energy input into the printed material, corresponds to only half of the wavelength of the originally free microwave that was supplied through the hollow guide.

In order to form the microwave field, resonators 2 and 3 are connected via hollow guides, depicted as lines in the diagram, to a suitable system for microwave generation 6. The conveyor belt 1 and the printed material located on it move in the direction of the arrow 7 through the resonators 2, 3, and to be precise for example, at a speed of up to one meter per second. The leakage radiation that emerges out of the through-put openings of the resonators can be reduced by the assembly of a so-called choke structure or by using absorbing materials outside of the resonator.

FIG. 4 shows schematically a preferred sequence of resonators 8 to 11 in an overhead view onto the conveyor belt 1, on which a substrate or a printed material is conveyed in the conveyor direction 7. In FIG. 4, for example, four resonators 8 to 11 are arranged one after the other in the conveyor direction 7. In general, N resonators could be arranged one after the other in this way. In the resonators, standing microwaves are generated which have a wavelength λ. The respective wave progression causes areas of different field strength in the plane of the conveyor belt 1 or the printed material, which are indicated and symbolized in the areas of the resonators 8 to 11 in FIG. 4 by framed fields. Of course, the field strength progression is itself continuous. In particular, the regions of the respective field strength maxima are indicated in areas 12. From this it can be recognized that these maxima areas 12 of the resonators 8 and 11 arranged after one another are offset from each other in the crosswise direction to the conveyor direction 7, and to be precise, in the embodiment example according to FIG. 4, by λ/8 each time, which in the general case for N resonators, corresponds to an offset of λ/2N each, whereby in the case presented, N=4.

Figure 5:
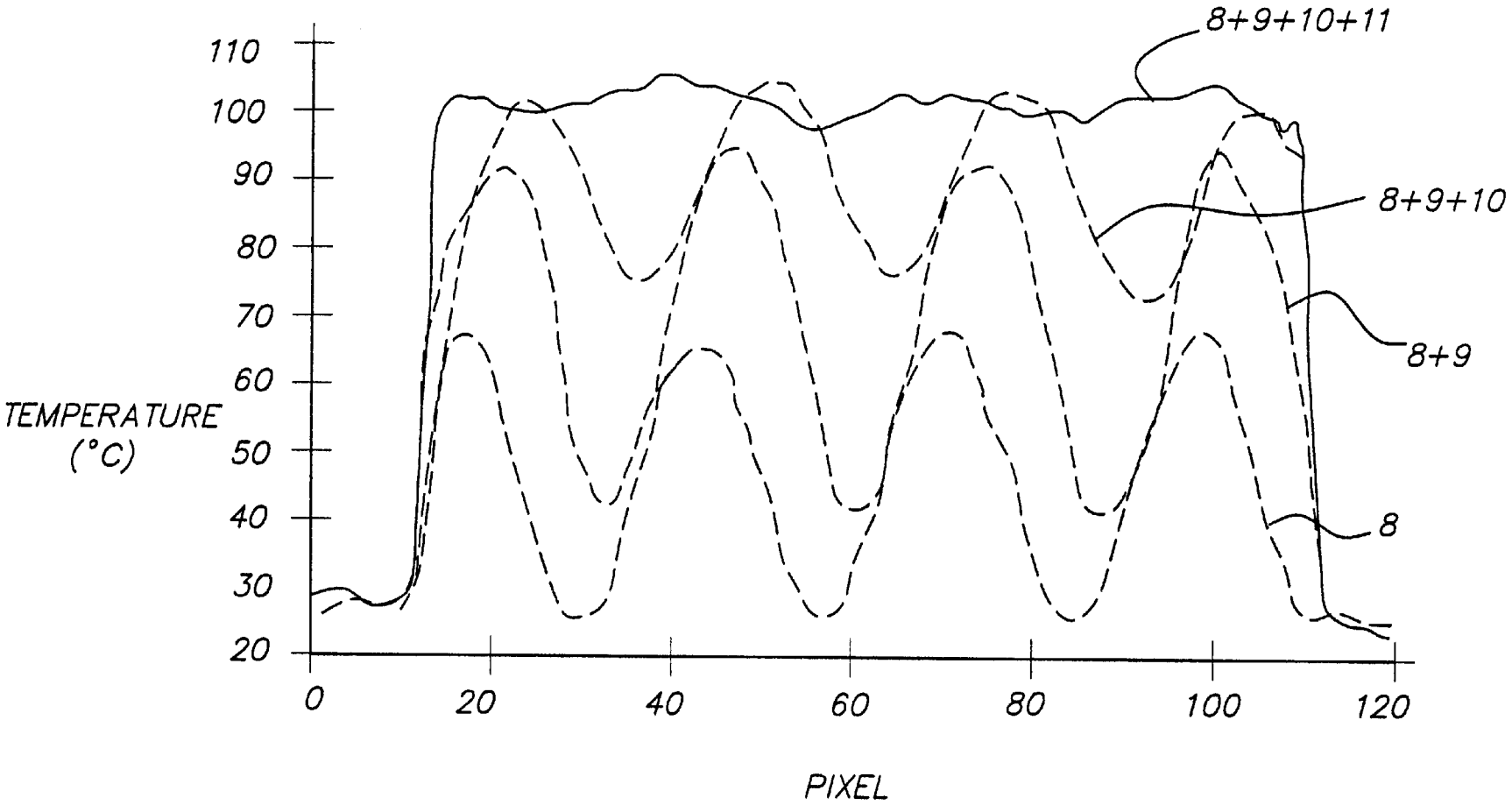
FIG. 5 which represents the temperature distribution of a paper on which, according to example 2, a toner image was fixed with an arrangement according to FIG. 4, measured with a line pyrometer (Bartec R2610) immediately after leaving the resonators, whereby the temperature progression is shown over the paper width when the first, the first two, the first three, and all four resonators are connected, at a pixel size, which is approximately 3 mm.

In FIG. 5, it is apparent that the offset arrangement of the standing microwaves or the field strength progressions in the resonators 8 to 11 according to FIG. 4 advantageously leads to an especially uniform heating of the printed material. Namely temperature progressions of the printed material are plotted over the width of the printed material (resolved or measured in pixels) in °C., and to be precise, when only one resonator 8 is connected, for a combination of resonators 8+9, for a combination of resonators 8+9+10 and for an operation of all resonators 8+9+10+11. The last allocated temperature progression is shown as uniform over the substrate width at approximately 100° C.

Figure 6:
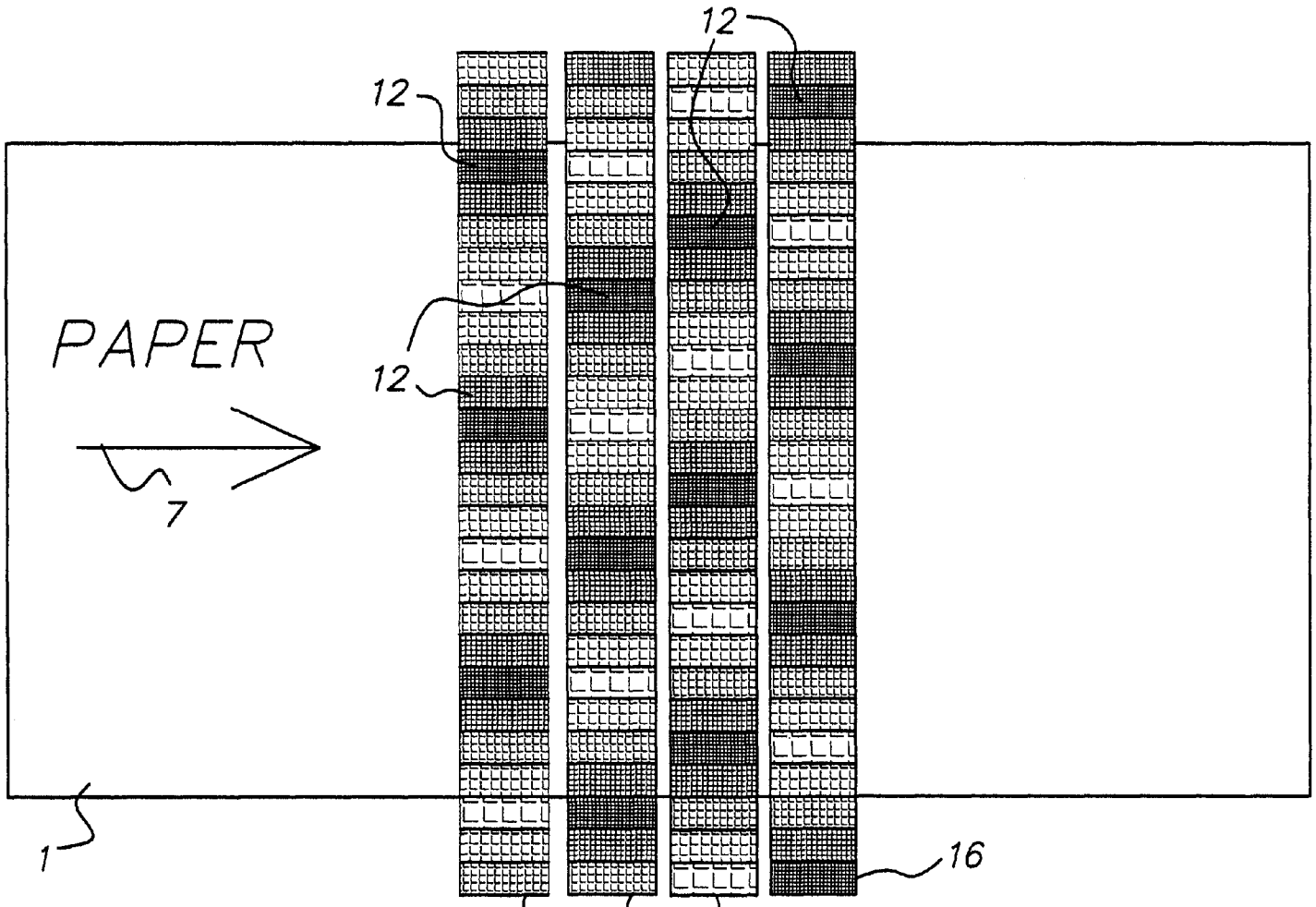
FIG. 6 an additional preferred arrangement of 4 resonators of a device according to the invention for fixing a toner image in two groups of two resonators each.

FIG. 6 shows, corresponding to FIG. 4, another preferred possibility of the arrangement of resonators 13 to 16 arranged one after the other in the conveyor direction. Again, the areas of the field strength maxima are shown in the plane of the printed material by 12. As can be seen in FIG. 6, resonators 13, 14 and 15, 16 are shown here divided in two groups that are subsequent to one another and each have two resonators. Generally, resonators could be divided into N/2 groups. Within each group, the field strength maxima 12 are offset from each other by λ/N, i.e. here at N=4, by λ/4. In addition, however, the field strength maxima of the resonators of the groups are also offset from each other, and to be precise, in such a manner that in total in the conveyor direction 7, field strength maxima 12 result which each in turn are offset from each other by λ/2N, or here by λ/8. As a result, a temperature progression also results from this, as in FIG. 5, when all of the resonators 13 to 16 are connected.

The arrangement of the resonators is not limited to the rectangular arrangement shown in FIGS. 3–6. In an arrangement at an angle to the transport direction 7 of the printed material, a uniform heating of the printed material occurs, but it has an increased space requirement.

The invention has been described in detail with particular reference to certain preferred embodiments thereof, but it will be understood that variations and modifications can be effected within the spirit and scope of the invention.

What is claimed is:

1. Device for fixing of toner onto a substrate or a printed material, especially a sheet-shaped printed material, preferably for a digital printer, characterized in that for the irradiation and heating of the toner, which exhibits a sharp drop of the modulus of elasticity G' from its solid to its liquid state when it is heated, at least one emitter that emits microwaves is provided, and more than one resonator is used for microwaves emitted by an emitter, the maxima of the resonators being offset from each other by the microwave length λ divided by two times the number of resonators.

2. Device according to claim 1, wherein at least one physical operating parameter that influences the irradiation can be regulated depending on a parameter that correlates to the energy input into the toner-printed material arrangement.

3. Device according to claim 1, wherein with such more than one resonator used, the maxima of the respectively subsequent resonators are offset from the previous ones by the microwave length λ divided by two times the number of resonators.

4. Device according to claim 1, wherein the maxima of the respectively subsequent resonators are offset rectified from the previous ones by λ divided by two times the number of resonators.

5. Device according to claim 4, wherein an even number of more than two resonators is used and the resonators are divided into N/2 groups each having N/2 with microwave field strength maxima offset from each other by λ/N, with N as the number of the resonators and λ as the microwave length, and the groups or the resonators are offset from each other in total by λ/2N.

6. Device according to claim 4, wherein the absorption of the printed material can be optimized in the subsequent resonators for the resonators that are previously connected.

7. Device according to claim 1, wherein the whole resonator, or a part of it, can be moved in oscillation.

8. Device according to claim 1, wherein the width of the resonator along the path of the printed material is selected to be as small as possible in order to simplify the handling of the printed material and it is selected large enough to keep the electric field in the resonator below the air-breakdown voltage.

9. Device according to claim 8, wherein the resonator has a width of approximately 1 to 10 cm.

10. Device according to claim 1, wherein the width of the resonator is selected depending on the speed of the printed material or the incoming irradiated microwave output of the resonator.

* * * * *